US006408907B1

(12) United States Patent
Lantz

(10) Patent No.: US 6,408,907 B1
(45) Date of Patent: Jun. 25, 2002

(54) WOOD SPLITTING ATTACHMENT

(76) Inventor: Gerald Adrian Lantz, 2616 Peters Corner Rd., Marydel, MD (US) 21649

( * ) Notice: Subject to any disclaimer, the term of this patent is extended or adjusted under 35 U.S.C. 154(b) by 0 days.

(21) Appl. No.: 09/902,368

(22) Filed: Jul. 10, 2001

(51) Int. Cl.[7] ..... B27L 7/00
(52) U.S. Cl. ..... 144/195.1; 144/193.1; 144/366
(58) Field of Search ..... 144/193.1, 195.1, 144/366, 4.8, 195.8; 280/727

(56) References Cited

U.S. PATENT DOCUMENTS 3,779,295 A * 12/1973 Balsbaugh ..... 144/195.1
4,240,476 A 12/1980 Rattray
4,444,231 A 4/1984 Dillon
4,470,441 A 9/1984 Wirsbinski
4,503,894 A * 3/1985 Gratowski ..... 144/195.1
4,782,870 A * 11/1988 Duerr ..... 144/195.1
4,945,960 A 8/1990 McCauley
5,651,404 A * 7/1997 Kraemer et al. ..... 144/193.1 X
5,803,141 A 9/1998 Patterson

* cited by examiner

*Primary Examiner*—W Donald Bray
(74) *Attorney, Agent, or Firm*—John C. Andrade, Esq.

(57) ABSTRACT

A wood splitting attachment primarily for use with a skid steer loader that allows the wood splitter to be operated in the horizontal or vertical mode, can be easily connected to a skid steer loader and with a wedge extractor that allows the splitting wedge to be easily extracted from the wood is the subject of the present invention.

18 Claims, 6 Drawing Sheets

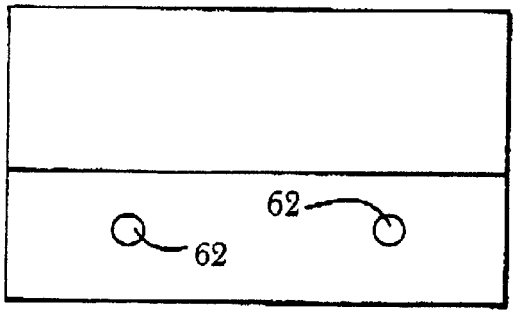
Fig. 4A
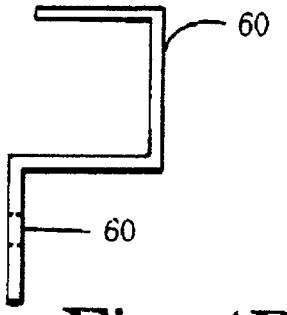
Fig. 4B
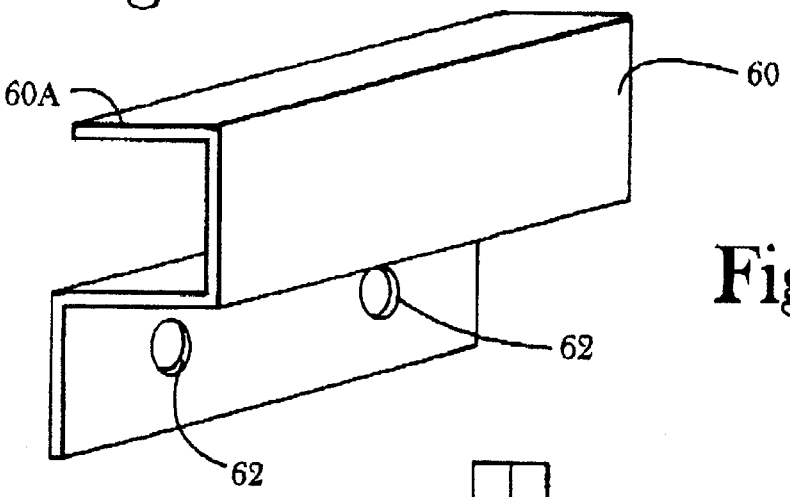
Fig. 4C
Fig. 5
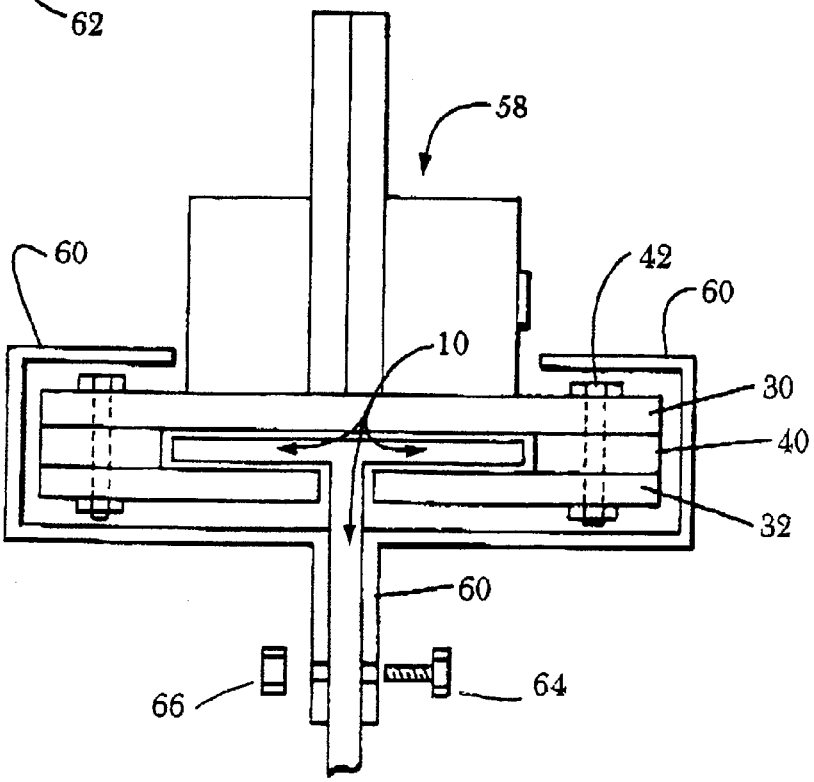

WOOD SPLITTING ATTACHMENT

BACKGROUND

The present invention relates to a wood splitting device specifically designed for use with a skid steer loader. Wood splitting devices are well known and can be attached to a variety of devices. U.S. Pat. No. 4,240,476 discloses a log splitting attachment for use with a tractor. The use of hydraulics in connection with a log splitting device is also known. Most log splitting devices operate in the horizontal mode, however some can also operate in the vertical mode. U.S. Pat. No. 5,651,404 discloses a wood splitting assembly mounted on a trailer or truck bed. Two separate wood splitting assemblies are operated independently of each other and use a double stage hydraulic system. Vertical wood splitters are also known in the art as is set out in U.S. Pat. No. 4,945,960. Wood splitters are typically characterized by the position in which they are operated either horizontal and roughly parallel to the ground or vertical and roughly perpendicular to the ground. There are advantages and disadvantages of horizontal and vertical wood splitters and it would be desirable to have a wood splitter that could efficiently operate in both the vertical and horizontal mode.

In recent years skid steer loaders have become very popular due to their versatility and mobility. They have been popular because of the wide selection of useful attachments and number of tasks they can complete in a minimal amount of time. The popularity of skid steer loaders is so strong that the cost to own one has become very affordable.

It would further be desirable to have a log splitter attachment that would be able to connect with a skid steer loader and utilize the hydraulics from the skid steer loader in its operation.

Many times in chopping logs a wedge becomes stuck in the log and typically an operator has to physically remove the log from the wedge. It would be desirable to have a means of extracting the wedge from the log automatically without having to physically extract the wedge by hand.

SUMMARY INVENTION

The wood splitting attachment of the present invention is usually operated in the vertical and horizontal mode and connects readily to a skid steer loader. The wood splitting attachment includes wood supporting means which would preferably include an "I" beam, a head plate which is rigidly connected at one end of the "I" beam and a post for supporting the "I" beam when the "I" beam is positioned parallel to the ground in the horizontal mode of operation. A splitting wedge means associated with the wood supporting means is used for splitting the wood. Preferably the wood splitting means would be a splitting wedge. This splitting wedge is operated by a hydraulic means that would be suitable for attachment to a hydraulic power source. The hydraulic means would be operatively connected to the wood supporting means and the splitting wedge means for moving the splitting wedge means along the wood supporting means.

One of the real advantages of the present invention is the ability to easily operate the wood splitting attachment in both the horizontal and vertical mode and easily reposition the wood splitter from one mode to the other. To accomplish this, diverter means converted to the hydraulic means for diverting hydraulic fluid is utilized. The hydraulic means includes a hydraulic supply line, hydraulic return line and a hydraulic cylinder operably connected to the splitting wedge means and a control valve connected to the hydraulic supply line and the hydraulic cylinder. The hydraulic cylinder is connected to the hydraulic return line. The diverting means preferably includes a first and second diverter where the first diverter is connected to the hydraulic supply line at a point in the line prior to connection with the control valve and a second diverter connected to the hydraulic return line at a point after the return line exits the hydraulic cylinder.

The control means are operatively connected to both the splitting wedge means and the hydraulic means. The control means preferably includes a control valve for controlling operation of the wood splitting attachment in said horizontal mode. This allows for operation of the wood splitting attachment in the horizontal mode while standing next to the attachment and loading wood to be split. In the vertical mode where operation from the cab of the skid steer loader is critical the attachment can be operated from the cab. Ease of operation in both the vertical and horizontal mode is because of the utilization of the diverter, control and hydraulic means.

The wood splitting attachment is most efficiently used when connected to a skid steer loader and the hydraulic fluid power source is mounted on the skid steer loader. The wood splitting attachment, including the wood supporting means, splitting wedge means and hydraulic means, has connecting means preferably a mounting plate attached to the wood supporting means and hydraulic lines attached to the skid steer loader hydraulic system and the skid steer loader is connected to the log splitting attachment by means of the mounting plate. In order to give the wood splitter attachment some stability in operation, support legs are rigidly connected between the posts and the mounting plate.

The novel connection of a wood splitting attachment to skid steer loader results in a wood splitter with the advantages of being able to operate in a horizontal and vertical mode and the advantages of incorporating a skid steer loader.

Another aspect of the present invention is the wedge extracting means, which are connected to the wood supporting means on exterior of the splitting wedge. Wedge extractor means are preferably removably attached to the wood supporting means and would typically comprise two "L" shaped pieces of steel welded together in such a way that they mount on the exterior of the splitting wedge so the splitting wedge can pass along the wood supporting means between the wedge extractors. When the splitting wedge is withdrawn the wedge extractors contact the wood, allowing the splitting wedge to retract from the wood, thus extracting the splitting wedge from the wood.

BRIEF DESCRIPTION OF THE DRAWINGS

The invention is further described in connection with the accompanying drawings and which:

FIG. 4A is a side view of the wedge extractors.

FIG. 4B is a perspective view of the wedge extractors.

FIG. 4C is a front view of the wedge extractors.

FIG. 5 is a front view of the splitting wedge assembly and the wedge extractors.

DETAILED DESCRIPTION OF THE INVENTION

Figure 1:
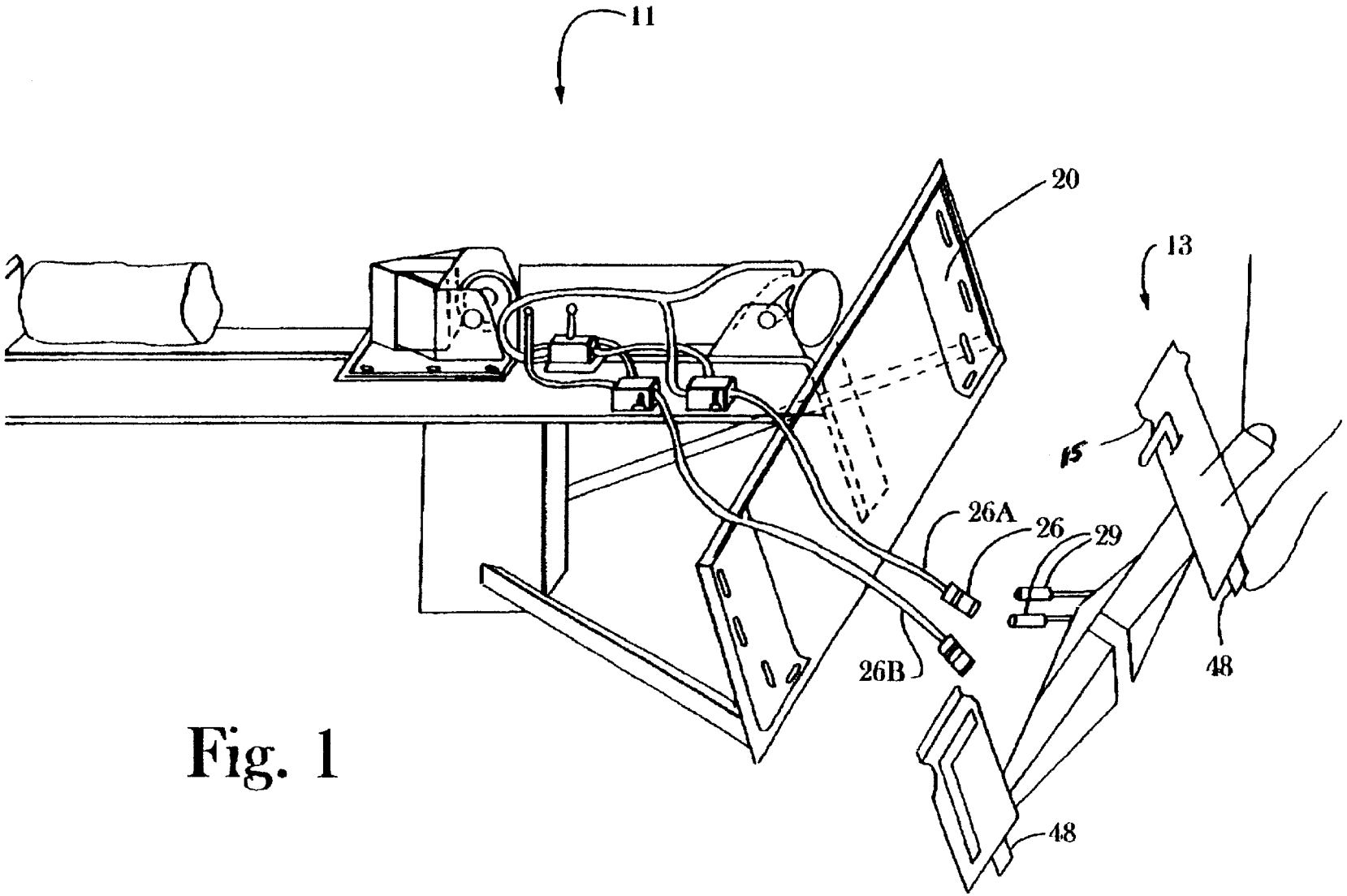
FIG. 1 is a perspective view of the current invention in the horizontal position.

The present invention is a log splitter 11, suitable for mounting on the front of a skid steer loader 13, by means of quick connect mounting plate 15 common to skid steer loaders as shown in FIG. 1.

Figure 1A:
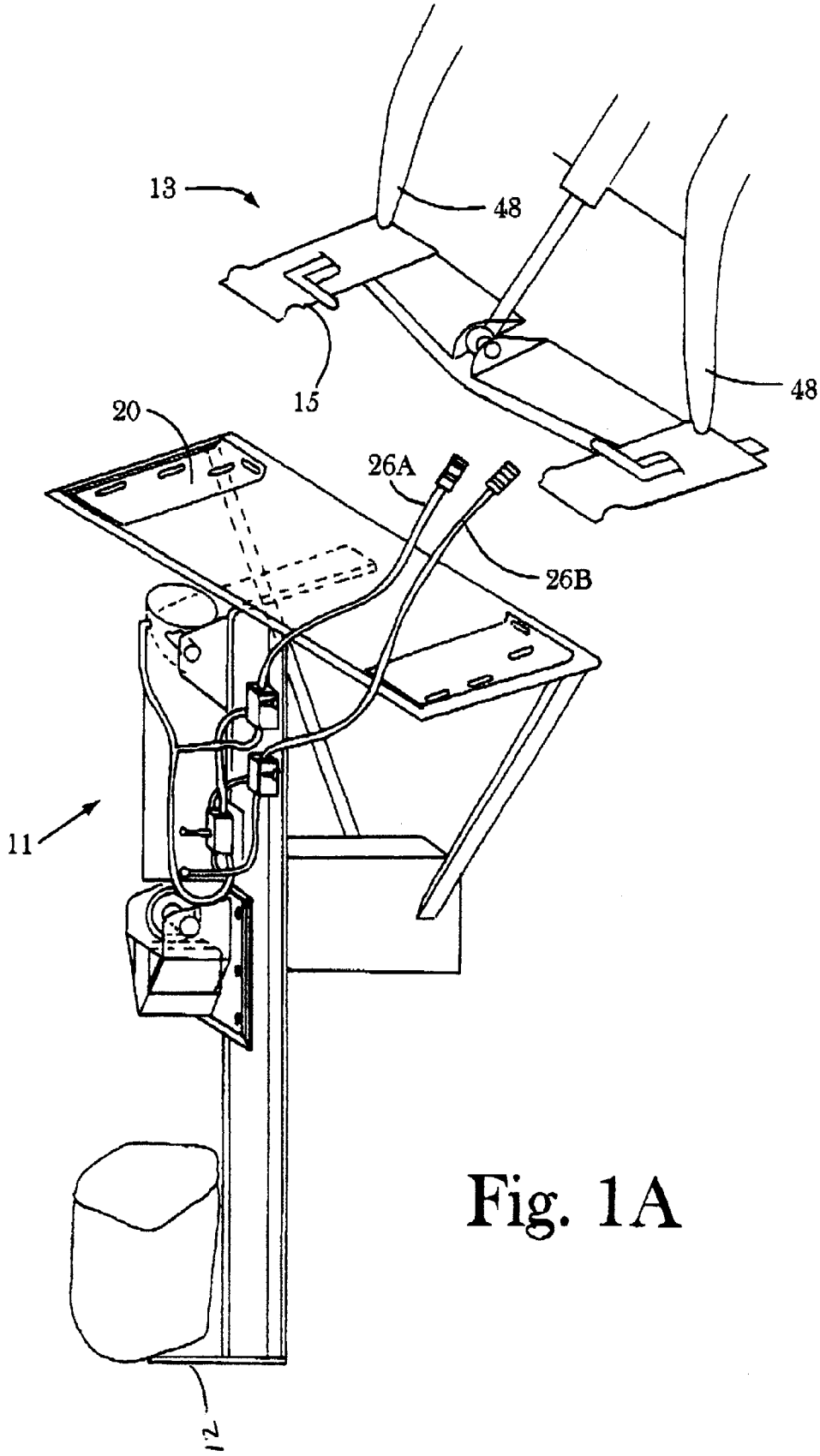
FIG. 1A is a perspective view of the current invention in the vertical position.
Figure 2:
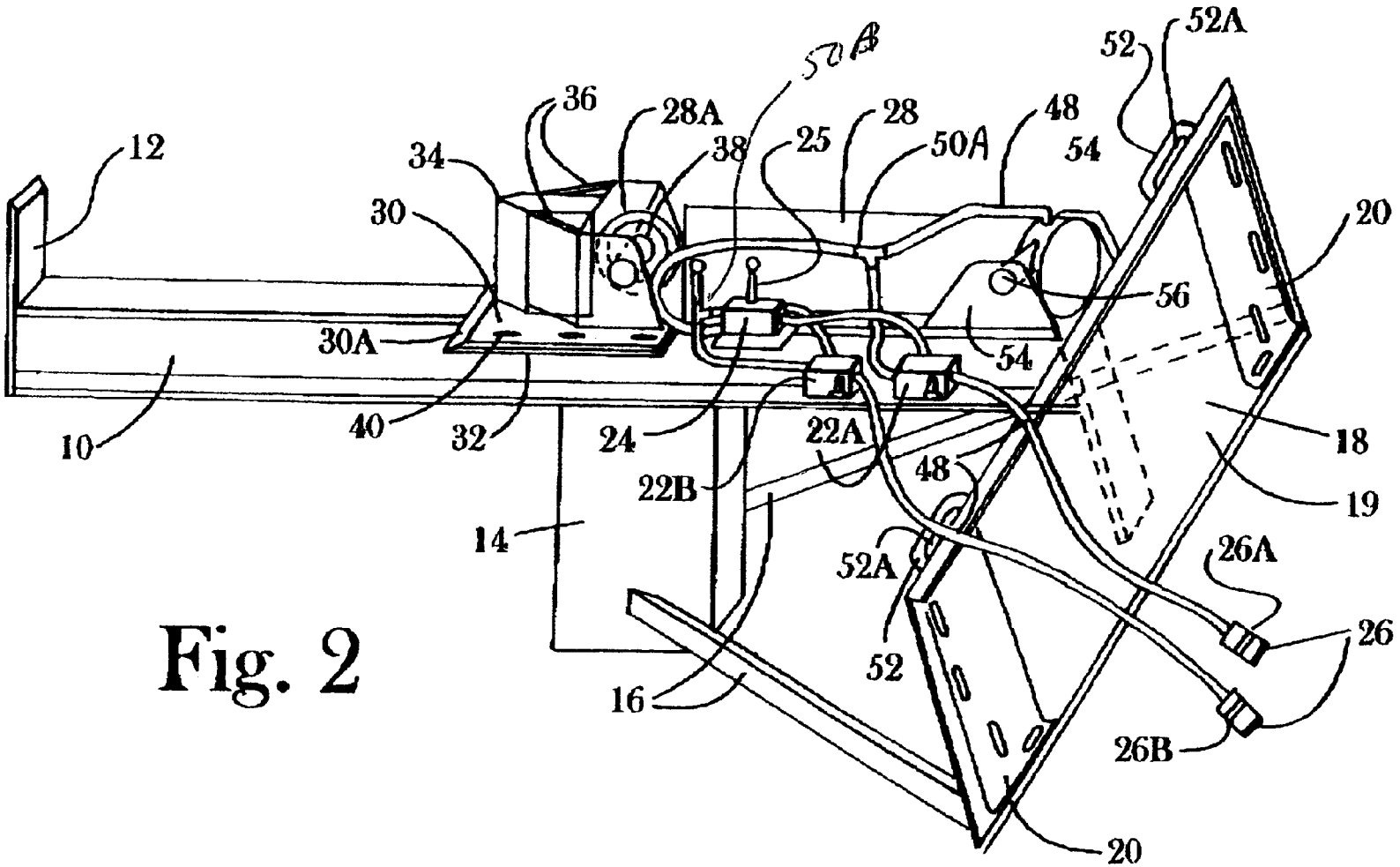
FIG. 2 is a perspective view of the invention in the horizontal position.

The splitter as seen in FIG. 2, is constructed of a rigid "I" beam 10, supported by a post 14. At one end is a flat piece of steel 18, with a common utility plate 20, welded to it to form a mounting plate 19 for quick attachment to the skid steer loader. On the top edge of the utility plate 20, are two foot plates 52, with an anti-skid surface 52A for entering the skid steer loader. At the other end of the "I" beam 10, is a head plate, a thick piece of steel with a beveled edge 12, for the log to rest against when being split in both the horizontal position as shown in FIG. 1, or vertical position as shown in FIG. 1A. The beveled edge allows the head plate 12 to slide under the log when used in the vertical position shown in FIG. 1A. Support legs 16, prevent bending between the "I" beam 10, and the mounting plate 19.

Figures 3A, 3B, 3C:
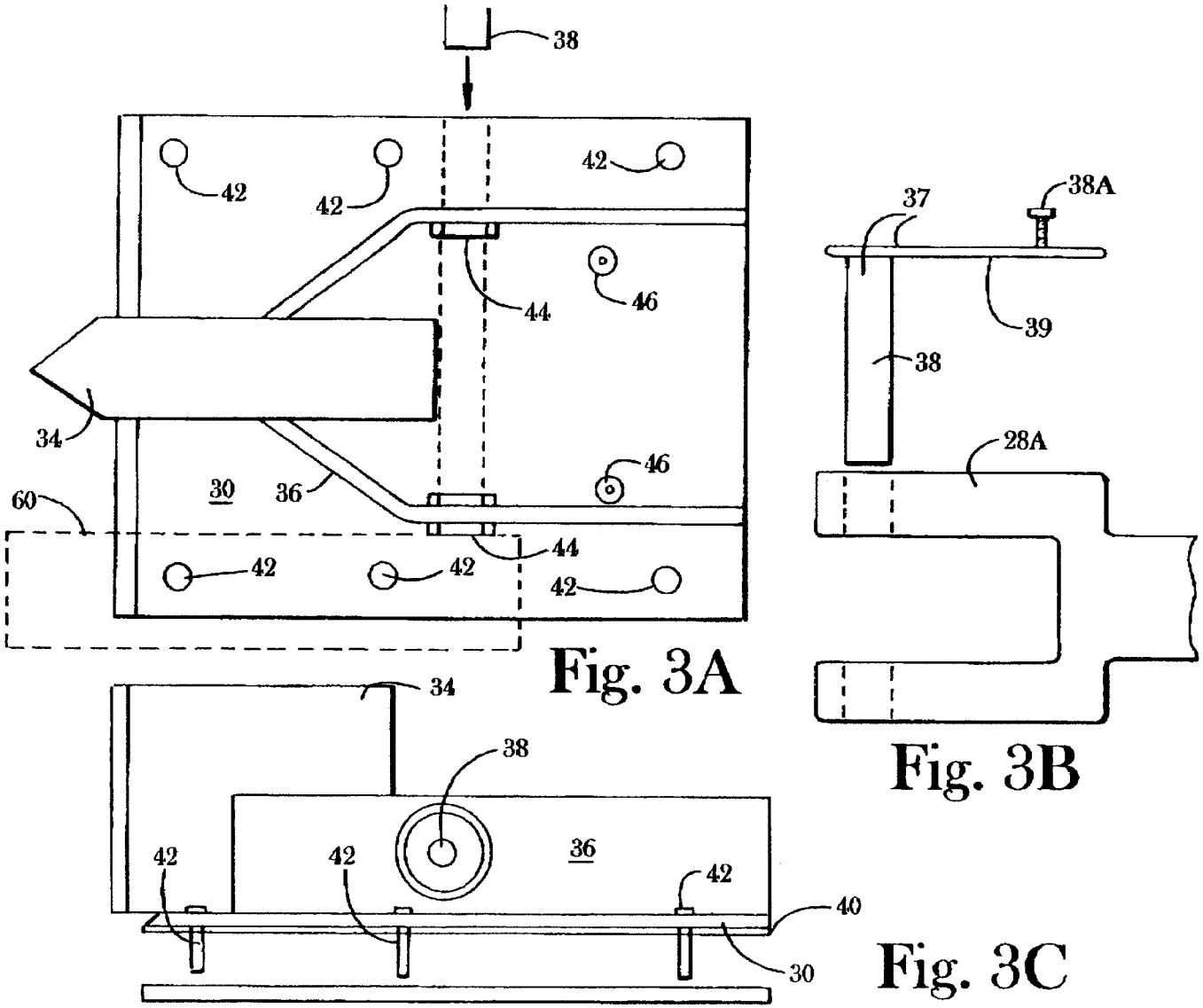
FIG. 3A is a top plain view of the two stage splitting wedge.
FIG. 3B is a top view of the hydraulic cylinder and splitting wedge connection.
FIG. 3C is a side view of the two stage splitting wedge.

On top of the "I" beam 10, as shown in FIG. 2, a hydraulic cylinder 28 is mounted, between two pieces of steel 54, with a pin 56, slid through holding the hydraulic cylinder 28 in place at the one end. At the other end is the hydraulic cylinder rod eye 28A, and pin assembly 37 as shown in FIG. 3B. It is attached to the splitting head assembly as seen in FIGS. 3A & 3B. In FIGS. 3A–C, the hydraulic cylinder rod eye 28A, is set between the pin collars 44, and is attached by a pin 38 with a flat ear 39, and held in place with a bolt 38A. The pin collars 44, are welded to a beveled piece of steel 36, that are welded to the splitting base 30, and the splitting wedge 34. The splitting base 30 has a beveled edge on the lead edge 30A (as shown in FIG. 2) and six holes drilled in it with bolts 42, to allow a spacer 40, the thickness of the beam, and a backing plate 32, (as shown in FIGS. 2 & 5) that is as wide as the "I" beam flange to be attached. The distance between the spacers 40 is slightly larger than the "I" beam 10, and so it will allow the entire wedge splitting assembly 58, as seen in FIG. 5, to slide back and forth on the "I" beam 10. Grease fitting 46, allows for easy greasing and minimal wear between the wedge splitting assembly 58, and "I" beam 10, and smooth operation.

This wood splitting invention is unique in that it attaches to a skid steer loader and can be utilized in the vertical and horizontal positions without having to physically place the splitter in either position. In the vertical position the skid steer loader can be driven over to the larger logs and the log positioned on the splitter without having to physically lift or tilt the device by hand. When in the vertical position the logs would not have to be physically handled. When using the log splitter in the horizontal mode, it will not have to be detached from the skid steer loader, simply changing the hydraulic flow and repositioning the attachment for use in the horizontal mode provides for maximum versatility and log splitting production.

Splitting in the horizontal position is accomplished by first, positioning the skid steer loader 13, as shown in FIG. 1, in line with utility plate 20 and attaching it to the skid steer loader 13 using the locking pins 48, and then attaching both hydraulic lines 26, to the skid loader auxiliary hydraulics 29. The locking pins 48 and triple stage hydraulics, the ability to continuously flow, stop and start, and flow in reverse, all controlled by switches in the cab of the skid steer loader are common to skid steer loaders. To begin the process, the continuous flow hydraulic switch (not shown) on the skid steer loader is activated. The hydraulic fluid enters the coupler and supply line 26A, as shown in FIG. 2, travels through the first diverter 22A, and to the control valve 24 and stops. The operator, standing along-side the splitter places a log onto the "I" beam 10, then pulls the control valve lever 25, towards the head plate 12. The hydraulic fluid then passes through the control valve 24, through the first "T" fitting 50A, to the back side of the hydraulic cylinder 28, pushing the splitting wedge assembly 58, down the "I" beam, 10, contacting the log, splitting it. For operator safety, the wedge splitting assembly 58, as shown in FIG. 5 stops several inches short of the head plate 12, eliminating a pinch point. This is an important feature in that should the operator's hand, arm or other body parts be placed between the splitting wedge 34 and the head plate 12 an injury is much less likely to occur. The beveled pieces of steel 36 in each side of the wedge act as a log separator, aiding the splitting process by helping to separate the log while the splitting wedge 34, travels down the "I" beam 10. The fluid on the exhaust side of the hydraulic cylinder is pushed out and is blocked off by the second diverter 22B, and is pushed back through the second "T" fitting 50B, into the control valve 24, through the other side of the second diverter 22B, back to the skid steer loader. The control valve lever 25 is pulled towards the skid steer loader and the splitting wedge assembly 58 returns to its standing position ready for another log.

FIGS. 4A–C depict a three dimensional view of the wedge extractors 60. The wedge extractors 60 consist of two pieces of "L" shaped angled steel, welded together, and bolted with bolts 64 and nuts 66 through bolt holes 62 as seen in FIG. 5 to each side of the "I" beam 10. Both of the front edges of the wedge extractors 60A (the edge closest to the head plate 12) are parallel with each other and the cutting edge of the splitting wedge 34. They are also wrapped around the sliding wedge splitting assembly 58 as shown in FIG. 5 with sufficient clearance not to interfere with the movement of the splitting assembly. At times during either horizontal or vertical splitting the wedge 34 becomes stuck in the log. By returning the splitting wedge assembly 58 back to the starting position with the log still stuck onto the splitting wedge 34, the wedge extractors 60 are positioned onto the "I" beam 10 to dislodge the log from the splitting wedge 34 separating the log and wedge 34. This eliminates having to physically wrestle the log from the splitting wedge in the horizontal position or having to exit the skid steer loader to dislodge the log in the vertical position maximizing log splitting production.

Figure 6:
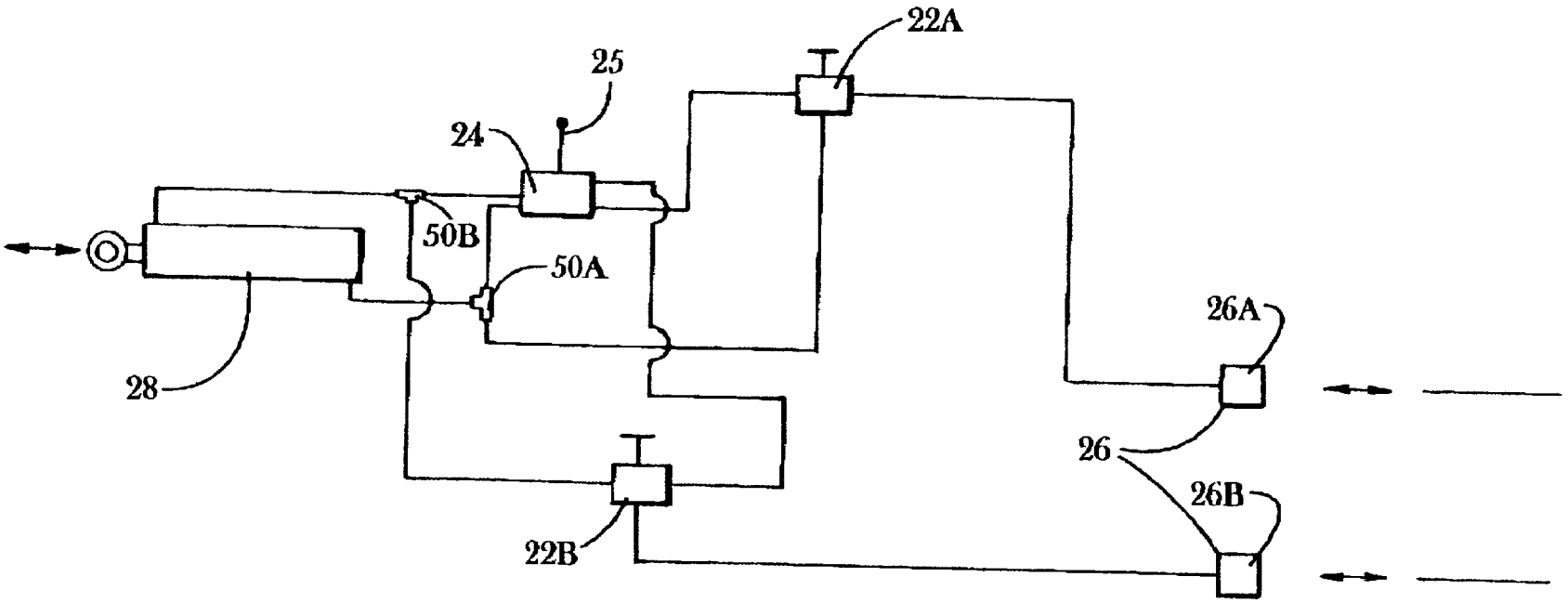
FIG. 6 is a schematic diagram of the hydraulic hose and plumbing hardware.

FIG. 6 is a hydraulic hose schematic depicting the proper placement of hardware to make the current invention operate. In the horizontal position with the skid steer loaders continuous flow hydraulic fluid activated, hydraulic fluid enters through the supply coupler 26A, then travels through the diverter 22A, to the control valve 24. When the operator activates the control valve lever 25, fluid continues through the control valve 24 through the first "T" fitting 50A to the back side of the hydraulic cylinder 28 causing the hydraulic cylinder 28, to stroke out. Fluid on the exhaust side of the hydraulic cylinder 28 is pushed out and through the second "T" fitting 50B, to the other diverter 22B where it is stopped and passes back through control valve 24, through diverter 22B and diverted back to the skid steer loader through the return coupler 26B. By stroking the control valve handle the other way the hydraulic cylinder will return.

In the vertical position both diverters 22A and 22B are engaged to allow the hydraulic fluid to flow from the skid steer loader, around the control valve to the hydraulic cylinder and return from the hydraulic cylinder around the control valve back to the skid steer loader. By starting, stopping and reversing the hydraulic fluid flow from the switch inside the cab of the skid steer loader you can control the direction of the hydraulic cylinder from inside the cab.

I claim:

1. A wood splitting attachment compromising:

wood supporting means;

means for splitting wood associated with said wood supporting means;

hydraulic means suitable for attachment to a hydraulic fluid power source, operatively connected to said wood supporting means and operatively connected with said splitting wedge means for moving said splitting wedge means along said wood supporting means;

diverting means connected to said hydraulic means for diverting hydraulic fluid, so that said wood splitting attachment can be operated in a horizontal and vertical mode; and control means operatively connected to both said splitting wedge means and said hydraulic means.

2. The wood splitting attachment of claim 1, wherein said hydraulic means includes a hydraulic supply line and a hydraulic return line and a hydraulic cylinder operatively connected to said splitting wedge means and said control means includes a control valve for controlling operation of said wood splitting attachment in said horizontal mode, connected to said hydraulic supply line and said hydraulic cylinder, said hydraulic cylinder connected to said hydraulic return line.

3. The wood splitting attachment of claim 2, further comprising a first and second diverter, said first diverter connected to said hydraulic supply line at a point in said line prior to connection with said control valve and a second diverter connected to said hydraulic return line at a point after said return line exits said hydraulic cylinder.

4. The wood splitting attachment of claim 3, wherein said splitting wedge means is a splitting wedge.

5. The wood splitting attachment of claim 1, further comprises a mounting plate attached to said wood supporting means.

6. The wood splitting attachment of claim 1, wherein said hydraulic fluid power source is mounted on a skid loader and said skid loader is connected to said wood splitting attachment by means of said mounting plate.

7. The wood splitting attachment of claim 6, further comprising a wedge extractor rigidly mounted on the exterior of said wood supporting means.

8. The wood splitting attachment of claim 7, wherein wood supporting means includes an "I" beam; a head plate rigidly connected at one end of said "I" beam, and a post for supporting said "I" beam when said "I" beam is positioned parallel to the ground in a horizontal mode.

9. The wood splitter attachment of claim 8, further comprising support legs rigidly connected between said post and said mounting plate.

10. A wood splitter comprising:

a skid steer loader having a hydraulic power source:

wood supporting means:

means for splitting wood associated with said wood supporting means:

hydraulic means connected to said skid loader hydraulic power source:

connecting means for attaching said wood supporting means, said splitting wedge means and said hydraulic means to said skid steer loader.

11. The wood splitter of claim 10 further comprising a wedge extractor mounted on the exterior of said wood supporting means.

12. The wood splitter of claim 11 further comprising diverter means for diverting hydraulic fluid so that said wood splitter means can be operated in a horizontal or vertical mode.

13. A wood splitter comprising:

wood supporting means:

means for splitting wood associated with said wood supporting means;

wedge extracting means: connected to said wood supporting means on the exterior of said splitting wedge;

hydraulic means for removing said splitting wedge means along said wood supporting means.

14. The wool splitter of claim 13 wherein the splitting wedge means is a splitting wedge.

15. The wood splitter of claim 14 further comprising a mounting plate connected to said wood supporting means.

16. The wood splitter of claim 14 when said hydraulic means includes a hydraulic cylinder and a hydraulic power source.

17. The wood splitter of claim 16 further comprising a skid steer loader, wherein said hydraulic power source is positioned on said skid steer loader.

18. The wood splitter of claim 13 wherein said wedge extracting means are removably attached to said wood supporting means.

* * * * *